United States Patent [19]

Forestier et al.

[11] 4,204,502

[45] May 27, 1980

[54] ONCE-THROUGH FORCED-CIRCULATION STEAM GENERATOR

[75] Inventors: Jean Forestier, Montrouge; Bernard Leblanc, Paris; Marcel Monteil, Broca; Pierre Monteil, Esvres, all of France

[73] Assignee: Commissariat a L'Energie Atomique, Paris, France

[21] Appl. No.: 902,251

[22] Filed: May 2, 1978

[30] Foreign Application Priority Data

May 16, 1977 [FR] France ..... 77 14888

[51] Int. Cl.[2] ..... F22B 1/06

[52] U.S. Cl. ..... 122/32; 165/163

[58] Field of Search ..... 122/32, 33; 165/112, 165/113, 114, 158, 163, 74

[56] References Cited

U.S. PATENT DOCUMENTS

| | | | |
|---|---|---|---|
| 3,187,807 | 6/1965 | Ammon | 122/32 |
| 3,831,673 | 8/1974 | Hayden et al. | 122/32 |
| 3,906,905 | 9/1975 | Andrieu et al. | 122/32 |
| 4,046,110 | 9/1977 | Fritz et al. | 122/32 |

*Primary Examiner*—Edward G. Favors

[57] ABSTRACT

A bundle of J-shaped tubes uniformly spaced in radial planes about the axis of a cylindrical shell is provided for the circulation of a primary fluid between on the one hand an inlet header delimited by a central tube plate and by the top dished end of the shell and on the other hand a toric outlet header which is partly delimited by the peripheral tube plate and the shell wall and is located above an annular space between the shell wall and a coaxial inner skirt. At least one nozzle for the supply of secondary fluid in the liquid state opens into the annular space and a lateral chamber is formed within the shell between the primary fluid inlet and outlet headers for collecting the secondary-fluid steam produced in contact with the tubes.

7 Claims, 2 Drawing Figures

ONCE-THROUGH FORCED-CIRCULATION STEAM GENERATOR

This invention relates to a forced-circulation steam generator of the once-through type in which a primary fluid circulated through a tube bundle exchanges heat with a secondary fluid in order to convert this latter to slightly superheated steam as a result of a single passage through said generator. An equipment unit of this type can preferably although not exclusively be adapted to operate in conjunction with an installation for the production of electric power by expansion of the steam produced in turbines whilst the primary fluid which supplies the heat required for vaporization is pressurized light or heavy water derived from a nuclear reactor. The secondary fluid fed to the steam generator preferably consists of water which is supplied partly by a feed water station and partly by a circulation system for withdrawing water from the steam generator itself at the vaporization temperature, the water thus drawn-off being employed for reheating the steam between the high-pressure and low-pressure cylinders of the turbines.

A number of different designs of once-through steam generators are already known in which the primary fluid circulates within either straight or slightly wavy tubes grouped together in a vertical bundle, said tubes being intended to communicate through two plates with two inlet and outlet headers respectively. The tube bundle and the tube plates are arranged within an outer shell which is also provided with secondary fluid inlet nozzles as well as a nozzle for removal of the steam produced.

The present invention relates to another type of superheated steam generator in which the tube bundle is arranged in a novel manner in order to ensure better operation of the unit, especially by means of more effective cooling of the tube plates, thus reducing thermal stresses in said plates and stresses exerted on the tubes as a result of differential expansions.

In accordance with the invention, the steam generator under consideration comprises an outer shell constituted by a lateral wall having a generally cylindrical shape and a vertical axis, an inner skirt which is coaxial with the outer shell and delimits an annular space with the lateral cylindrical wall. The lower end of said skirt has a free edge located at a distance from the bottom dished end which closes the outer shell. The steam generator further comprises a central tube plate which extends horizontally in the vicinity of a top dished end which is located opposite to the bottom dished end, a peripheral tube plate which is parallel to the central tube plate and placed within the annular space beneath said central tube plate, and a bundle of tubes each having the shape of a J and uniformly distributed in radial planes about the axis of the lateral cylindrical wall. The invention is distinguished by the fact that a primary fluid is intended to circulate between an inlet header delimited on the one hand by the central tube plate and the top dished end and on the other hand by a toric outlet header partly delimited by the peripheral plate and the lateral cylindrical wall, said outlet header being mounted above the annular space formed between the lateral cylindrical wall and the inner skirt. At least one inlet nozzle for the supply of secondary fluid in liquid form opens into the annular space beneath the peripheral plate. A lateral chamber is placed within the shell between the primary fluid inlet and outlet headers for collecting the secondary-fluid steam produced in contact with the tubes.

In a first embodiment of the invention, the primary fluid inlet and outlet headers form between them a free annular space through which the steam produced in contact with the tubes penetrates into the lateral chamber. In another alternate embodiment, the inner skirt forms with the sides of the primary fluid inlet and outlet headers a continuous partition-wall provided with orifices for the passage of the secondary-fluid steam opposite to the lateral chamber.

In accordance with an advantageous feature, the nozzle or nozzles for admission of the secondary fluid into the annular space are associated within the outer shell with circumferential distribution elements adapted to distribute the flow of fluid within said space.

In accordance with a further distinctive feature, the bottom end of the outer shell has an inlet for drawing-off a fraction of the liquid secondary fluid at the vaporization temperature, especially through an axial nozzle provided in the bottom dished wall of the shell. Advantageously, the liquid secondary fluid inlet is provided with an anti-vortex deflector.

In accordance with yet another distinctive feature, the regions delimited internally and externally with respect to the inner skirt are provided with a series of parallel horizontal spacer grids for guiding and maintaining the tubes, said grids being traversed by the tube bundle in a non-leak-tight manner by means of broached holes.

Further distinctive features of a forced-circulation steam generator as constructed in accordance with the invention will become apparent from the following description of one exemplified embodiment which is given by way of indication without any limitation being implied, reference being made to the accompanying drawings in which.

Figure 1:
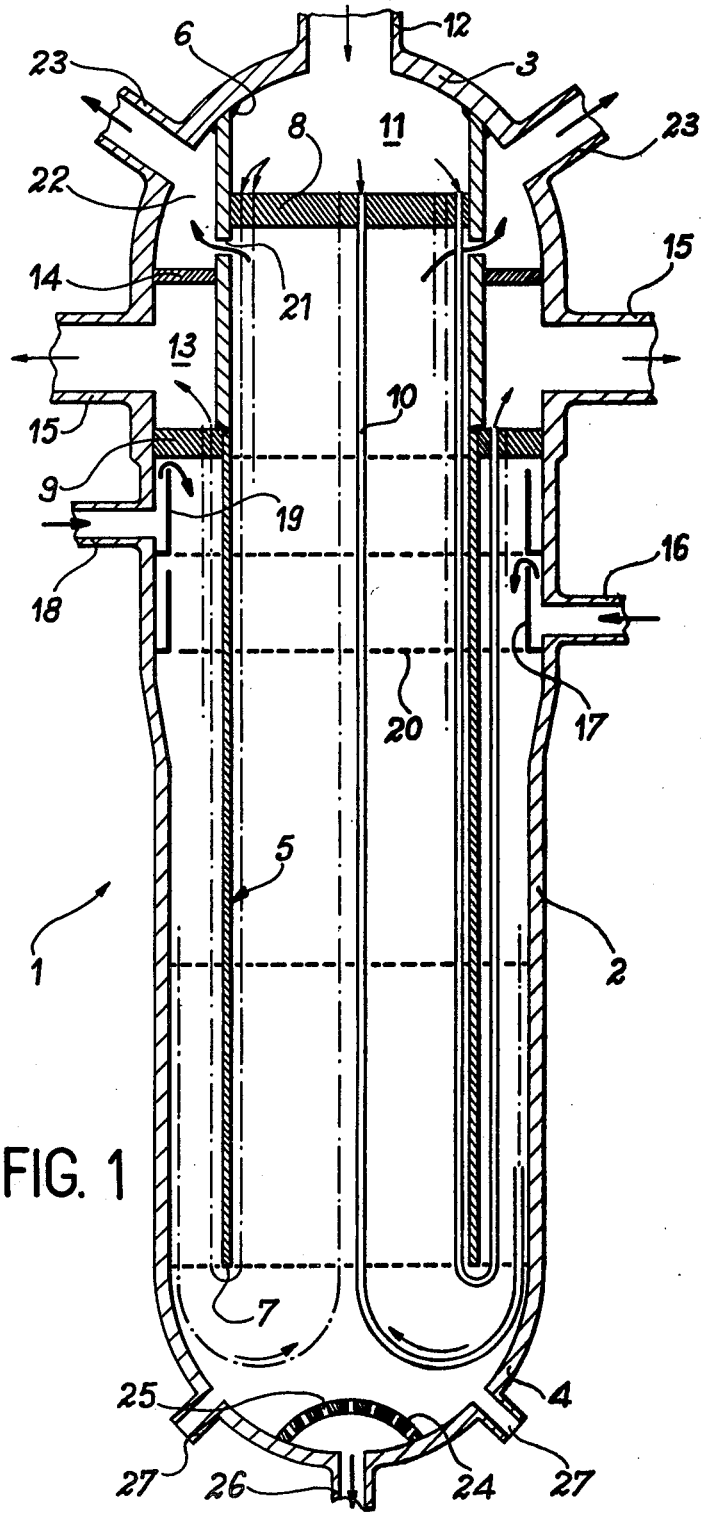
FIG. 1 is an axial sectional view of a first embodiment.

The steam generator shown in FIG. 1 and generally designated by the reference numeral 1 is mainly composed of an outer shell 2 having a lateral wall of cylindrical shape closed by a top dished end 3 and a bottom dished end 4.

There is mounted within the outer shell 2 an inner skirt 5 which is coaxial with the lateral cylindrical wall of said shell, the upper end 6 being rigidly fixed to the top dished end 3. On the other hand, the lower end 7 of the skirt 5 is free, said lower end being located at a suitable distance from the bottom dished end 4 in order to permit the flow of secondary fluid as will be explained hereinafter.

In accordance with the invention, the steam generator 1 is provided with two tube plates 8 and 9 respectively. The plate 8 or central tube plate is carried by the inner skirt 5 in the vicinity of the top dished end 3 whilst the peripheral plate 9 is mounted within the annular space formed between the lateral cylindrical wall of the shell 2 and the external surface of the skirt 5. Between the tube plates 8 and 9 extends a bundle 10 of tubes, each of which has the shape of a J and only one of which is shown in the figure in order to avoid undue complication. Said tubes extend within the interior of the skirt 5 from the central tube plate 8 and, after forming U-bends beneath the lower end 7 of said skirt, extend upwards within the annular space to the peripheral tube plate 9.

The central tube plate 8 delimits with the upper end of the skirt 5 and the top dished end 3 of the shell 2 an inlet header 11 for a primary fluid which is admitted into the steam generator through an inlet nozzle 12 formed axially in the top portion of the end wall 3. Said primary fluid preferably consists of pressurized light water or heavy water obtained from a nuclear reactor (not shown). From the header 11, said fluid flows into the tube bundle 10 within the interior of the tubes before collecting within a toric outlet header 13 delimited between the peripheral tube plate 9 and a horizontal partition-wall 14 which is parallel to this latter and mounted between the shell 2 and the skirt 5 above the plate 9. The primary fluid is finally discharged from the header 13 through outlet nozzles 15 provided in suitable number such as two nozzles, for example, in diametrically opposite relation. Advantageously and as illustrated in the drawing, the skirt 5 which, in this first example of construction, forms a continuous partition-wall from its lower end 7 to the top dished end 3 of the shell 1, has a thickness at the level of the inlet header 11 and of the outlet header 13 which is substantially greater than its thickness beyond this latter in the region of the annular space provided between the lateral cylindrical wall of the shell and the skirt beneath the peripheral plate 9, especially in order to afford resistance to the forces arising from pressure differences inside and outside said headers.

The secondary fluid to be vaporized within the steam generator and usually consisting of water is introduced into the shell 2 in the liquid state within the annular space delimited between the shell and the skirt 5 by means of a first nozzle 16. Within the interior of the shell 2, said nozzle is associated with a distribution element 17 for suitably distributing the feed water flow within said annular space in contact with the legs of the tubes 10 which extend upwards to the peripheral tube plate 9. Preferably, a second nozzle 18 which is also associated with an annular distributor 19 serves to pass into the steam generator another secondary feed water flow at a higher temperature than the previous flow and derived from an ancillary circuit (not shown) after having reheated the steam for the turbines which utilize the steam produced by the generator. Said nozzle 18 is arranged especially with a view to ensuring that the flow of feed water which is passed into the shell 2 sweeps the bottom surface of the peripheral tube plate 9 in a suitable manner and limits thermal stresses in said plate.

The secondary water derived from the nozzles 16 and 18 which supply the annular space formed between the shell 2 and the inner skirt 5 flows downwards, passes beneath the free end 7 of the skirt 5 and then flows within the interior of this latter in contact with the legs of the tubes 10 within which the primary fluid derived from the inlet header 11 flows internally and in counter-current flow. Preferably, the lattice pitch of the tubes 10 is maintained within the bundle by means of horizontal spacer grids 20 pierced by broached holes so arranged as to permit efficient cooling of the tubes as the secondary fluid flows through said spacer grids, this being achieved by means of a judicious circulation of said fluid.

The steam formed by heat exchange with the primary fluid is collected beneath the central tube plate 8. In the example under consideration, the steam flows through the lateral orifices 21 provided in the skirt 5 in order to be collected within a lateral chamber 22, said chamber being delimited between the partition-wall 14 which forms the top wall of the outlet header 13 and the top dished wall 3 of the shell 2. Finally, said steam is withdrawn from the generator through nozzles 23 which are preferably two in number and in diametrically opposite relation.

Apart from the production of steam described in the foregoing, the generator makes it possible to draw-off a fraction of the flow of secondary water in liquid form at the vaporization temperature. To this end, the shell 2 is provided with an inlet formed by an axial nozzle 26 and an anti-vortex deflecting device 24 pierced by a series of holes 25. The secondary water withdrawn through the nozzle 26 is passed to the steam reheaters 7 (not shown) which are located between the high-pressure and low-pressure cylinders of the utilization turbines, then reinjected through the nozzle 18 by means of pumps (also omitted from the drawings). The secondary fluid which remains at the vaporization temperature and consists of water enriched with steam bubbles by virtue of the previous withdrawal of water rises in contact with the tubes 10 through the horizontal spacer grids 20 and continues to be vaporized; the water is then slightly superheated before being collected within the lateral chamber 22 and passed to the turbines. Finally, the bottom dished end 4 is advantageously provided with inlet nozzles 27 for an auxiliary feed of secondary water to the steam generator when the main feed is stopped for any reason. Said auxiliary water flow is primarily intended to cool the tubes 10 through which the primary fluid is continuously circulated.

Figure 2:
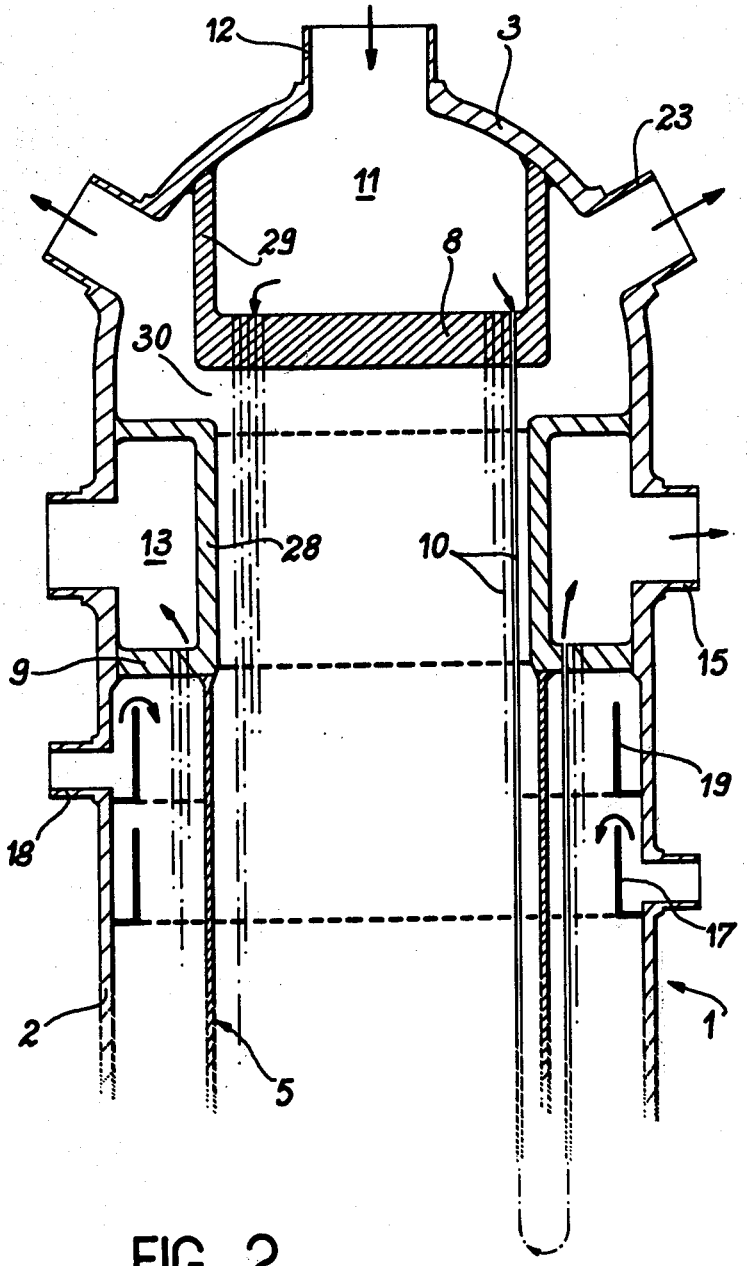
FIG. 2 is a second alternative embodiment of the steam generator.

FIG. 2 illustrates another alternative embodiment in which practically all the arrangements described in connection with the first embodiment are again shown, with the exception of the inner skirt structure which does not extend continuously to the top dished end 3 of the shell 2. In this alternative embodiment, the skirt 5 is in fact rigidly fixed to the inner edge of the peripheral tube plate 9 which forms an integral part of the toric primary fluid outlet header 13, said header being delimited by a wall 28 of revolution which is rigidly fixed at the time of assembly of the lateral cylindrical wall of the shell 2. In consequence, the inlet header 11 together with the central tube plate 8 is in turn delimited by a cylindrical wall 29. Thus the communication with the chamber 22 for the discharge of steam no longer takes place through orifices but through a space 30 which is left completely free between the headers 11 and 13.

The table given below lists the general thermodynamic characteristics of a steam generator in accordance with the invention and associated with a nuclear power reactor of the pressurized light-water type.

| | |
|---|---|
| Thermal power of the steam generator: | 1,387 MW |
| Primary fluid | |
| Flow rate | 6,238 kg/s |
| Inlet temperature | 329° C. |
| Outlet temperature | 292° C. |
| Secondary feed water | |
| Flow rate | 686.7 kg/s |
| Inlet temperature | 232.5° C. |
| Secondary reheat water | |
| Flow rate | 536.5 kg/s |
| Inlet temperature | 250.6° C. |
| Outlet temperature | 290° C. |
| Steam characteristics | |
| Flow rate | 686.7 kg/s |
| Pressure | 74 b. |

-continued

| | |
|---|---|
| Outlet temperature | 310° C. |

The once-through forced-circulation steam generator which is thus provided retains all the advantages of conventional steam generators of this type from an operational standpoint but also offers additional and specific advantages. In particular, the "J" tube design permits considerably enhanced individual flexibility of the tubes without affecting general structural rigidity. The J-tube design is also conducive to good operation of the tubes and maintains these latter in a good state by virtue of the reduction of stresses arising from differential expansions. Perfect adaptation of this type of steam generator to the use of pressurized water for steam reheating between high-pressure and low-pressure turbine cylinders offers the advantage of permitting an increase both in steam pressure and in thermodynamic efficiency; the structure of the unit also improves the general operation of the installation by reducing thermal stresses, especially at the level of the tube plates. Finally, withdrawal of water at the bottom end of the steam generator improves the general operation of the unit by permitting a certain degree of separation between steam and water during the boiling process. Moreover, the arrangement of the tube plates serves to optimize the tube lattice pitch within the annular space which is supplied with secondary water. This is achieved especially by giving the tubes within said space a smaller pitch than in the region which is in contact with the steam produced.

It is readily apparent that the present invention is not limited to the example of construction which has been more especially described with reference to the accompanying drawings but extends on the contrary to all alternative forms.

What we claim is:

1. A once through forced circulation steam generator for heat exchange between a primary fluid and a secondary fluid, comprising an outer shell constituted by a lateral wall having a generally cylindrical shape and a vertical axis, a bottom dished end and a top dished end closing said outer shell, an inner skirt which is coaxial with said outer shell and delimits an annular space with said lateral wall, the lower end of said skirt being such as to have a free edge located at a distance from said bottom dished end, a central tube plate extending horizontally in the vicinity of said top dished end, a peripheral tube plate which is parallel to the central tube plate and placed within said annular space beneath said central tube plate, a bundle of tubes each having the shape of a J, an inlet header delimited on the one hand by said central tube plate and by said top dished end and on the other hand by a toric outlet header said outlet header being partly delimited by said peripheral tube plate and said lateral cylindrical wall, said outlet header being located above said annular space, at least one inlet nozzle opening into said annular space beneath said peripheral tube plate, and a lateral chamber placed within said shell between said inlet and outlet headers, said tubes being provided for the circulation of said primary fluid between said inlet and outlet headers, said nozzles serving to feed said secondary fluid in liquid form, said lateral chamber serving for collecting the said secondary fluid steam produced in contact with said tubes.

2. A steam generator according to claim 1, wherein the primary fluid inlet and outlet headers form between them a free annular space through which the steam produced in contact with the tubes penetrates into the lateral chamber.

3. A steam generator according to claim 1, wherein the nozzle or nozzles for admission of the secondary fluid into the annular space are associated within the outer shell with circumferential distribution elements adapted to distribute the flow of fluid within said space.

4. A steam generator according to claim 1, wherein the bottom end of the outer shell has an inlet for drawing-off a fraction of the liquid secondary fluid at the vaporization temperature through an axial nozzle provided in the bottom dished end of the shell.

5. A steam generator according to claim 4, wherein the liquid secondary-fluid inlet is provided with an anti-vortex deflector.

6. A steam generator according to claim 1, wherein the regions delimited internally and externally with respect to the inner skirt are provided with a series of parallel horizontal spacer grids for guiding and maintaining the tubes, said grids being traversed by the tube bundle in a non-leak-tight manner by means of broached holes.

7. A steam generator according to claim 1, wherein the tubes of the bundle have a smaller pitch within the annular space which is fed with liquid secondary fluid and a larger pitch in the central region in which the steam is produced.

* * * * *